US009068567B2

(12) United States Patent
Hitter et al.

(10) Patent No.: US 9,068,567 B2
(45) Date of Patent: Jun. 30, 2015

(54) RECIPROCATING PISTON PUMP SERVICEABLE WITHOUT TOOLS

(75) Inventors: Benjamin J. Hitter, Monticello, MN (US); David J. Thompson, Oak Grove, MN (US); Dennis R. Peterson, Isanti, MN (US); William M. Blenkush, Becker, MN (US)

(73) Assignee: GRACO MINNESOTA INC, Minneapolis, MN (US)

( * ) Notice: Subject to any disclaimer, the term of this patent is extended or adjusted under 35 U.S.C. 154(b) by 1019 days.

(21) Appl. No.: 11/426,239

(22) Filed: Jun. 23, 2006

(65) Prior Publication Data

US 2006/0292016 A1 Dec. 28, 2006

Related U.S. Application Data

(60) Provisional application No. 60/693,254, filed on Jun. 23, 2005.

(51) Int. Cl.
*F04B 53/22* (2006.01)
*F04B 53/16* (2006.01)

(52) U.S. Cl.
CPC ..... *F04B 53/16* (2013.01); *F04B 53/22* (2013.01)

(58) Field of Classification Search
CPC ..... F16D 1/04; F04B 39/127; F04B 47/02; F04B 53/147; F04B 53/16; F04B 53/02; B25G 3/04; B25G 3/08; B25G 3/24; F16B 7/0406; F16B 7/04262
USPC ..... 417/572, 360, 363, 423.15, 423.14; 403/310–312, 389; 92/128, 161
See application file for complete search history.

(56) References Cited

U.S. PATENT DOCUMENTS

| | | | | |
|---|---|---|---|---|
| 1,762,065 | A | 6/1930 | Lally | |
| 2,764,100 | A | 9/1956 | Maisch | |
| 3,136,227 | A * | 6/1964 | Williams | 92/63 |
| 3,471,175 | A | 10/1969 | Newton | |
| 3,559,574 | A | 2/1971 | Gates | |
| 3,947,152 | A | 3/1976 | Ross et al. | |
| 4,049,364 | A | 9/1977 | Ross et al. | |
| 4,211,519 | A | 7/1980 | Hogan | |
| 5,165,867 | A * | 11/1992 | Dockery | 417/360 |
| 5,538,402 | A | 7/1996 | McKenney | |
| 5,573,385 | A | 11/1996 | Chevallier | |
| 5,740,718 | A * | 4/1998 | Rathweg | 92/168 |
| 6,000,916 | A | 12/1999 | Martin et al. | |
| 6,135,726 | A * | 10/2000 | Robertson et al. | 417/360 |
| 6,311,943 | B1 * | 11/2001 | Tang | 248/343 |
| 6,764,284 | B2 * | 7/2004 | Oehman, Jr. | 417/360 |
| 2003/0026647 | A1 * | 2/2003 | Sasaki et al. | 403/288 |
| 2004/0208756 | A1 * | 10/2004 | Adahan | 417/360 |
| 2005/0249610 | A1 * | 11/2005 | Fischer | 417/360 |

OTHER PUBLICATIONS

International Preliminary Report on Patentability, Chapter II, issued in PCT/US2012/046714, mailed Nov. 27, 2013, 6 pages.

* cited by examiner

*Primary Examiner* — Charles Freay
*Assistant Examiner* — Philip Stimpert
(74) *Attorney, Agent, or Firm* — Faegre Baker Daniels LLP

(57) ABSTRACT

The "no tools" pump removal system comprises a bearing housing attached to the drive housing. The bearing housing has a hinged door that when opened allows removal of the pump pin and then the pump. The bearing housing is provided with a latch assembly and a handle. A safety latch retains the handle in place during operation and until it is desired to remove the pump.

19 Claims, 11 Drawing Sheets

RECIPROCATING PISTON PUMP SERVICEABLE WITHOUT TOOLS

RELATED APPLICATIONS

This application claims the benefit of U.S. Application Ser. No. 60/693,254 filed Jun. 23, 2005.

BACKGROUND OF THE INVENTION

Airless sprayers having reciprocating piston pumps are popular for applying architectural coatings. One problem with prior art pumps is the need to use tools to service such pumps when it comes to installation and removal.

SUMMARY OF THE INVENTION

The "no tools" pump removal system comprises a bearing housing attached to the drive housing. The bearing housing has a hinged door that when opened allows removal of the pump pin and thence the pump. The bearing housing is provided with a latch assembly and a handle. A safety latch retains the handle in place during, operation and until it is desired to remove the pump.

To remove, first the pressure in the pump is relieved (using the mechanism present in all airless pumps) and then the paint hose is removed by unscrewing the ribbed fitting and fine thread by hand. At that point, the safety latch is lifted and the handle swung outwardly releasing the u-bolt latch from the door. If the door will not swing freely outwardly (because of accumulated dried paint), the u-bolt may be positioned on the near side of the door and used to lever it outwardly to unstick the door. At this point, the pump pin can be grasped and removed which allows the pump to drop straight down for replacement or repacking.

To install the pump, the pump pin can be placed in the rod and then placed in the pin holder on the door to pull the rod out to the proper position such that the top of the collar on the pump cylinder is nearly against the mating shoulder in the bearing housing. The pump can then be positioned on the connecting rod and the pin slid into place. The door is then swung shut and the latch u-bolt placed over the door latch protrusion and the handle swung shut. The safety latch may then be operated.

It should be noted that the pump cylinder is supported only on top in the bearing housing cavity which allows the pump to drop during removal. The door supports the top and bottom of the pump cylinder taking up all of the downward force. The pump cylinder has a collar that slides into the bearing housing and has flat (not tapered) surfaces on top and bottom to prevent the collar from wedging into the bearing housing. An adjustment screw is provided where the door latches into the bearing housing to reduce unwanted movement.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
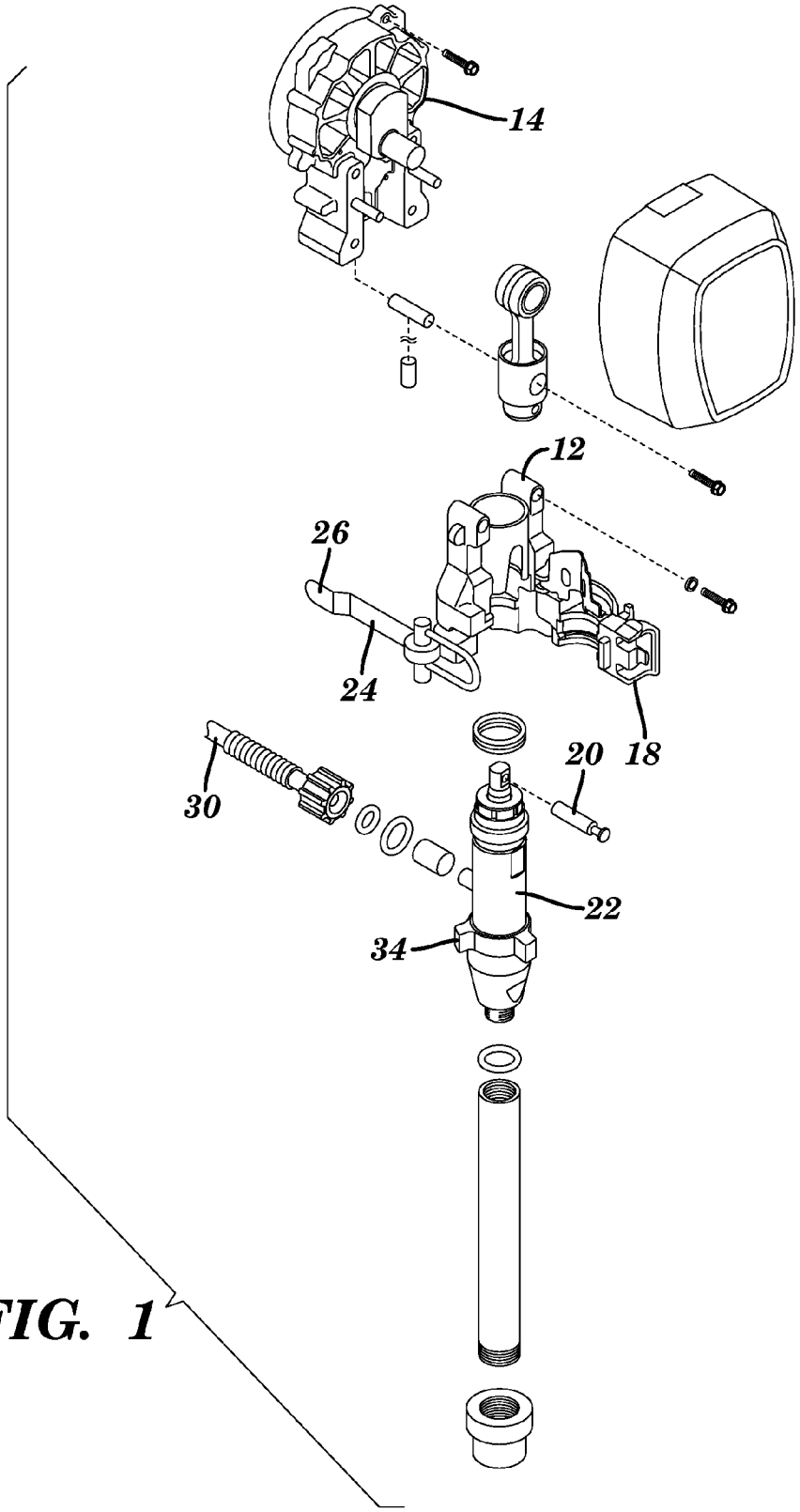
FIG. 1 is an exploded view of the pump of the instant invention.
Figure 2:
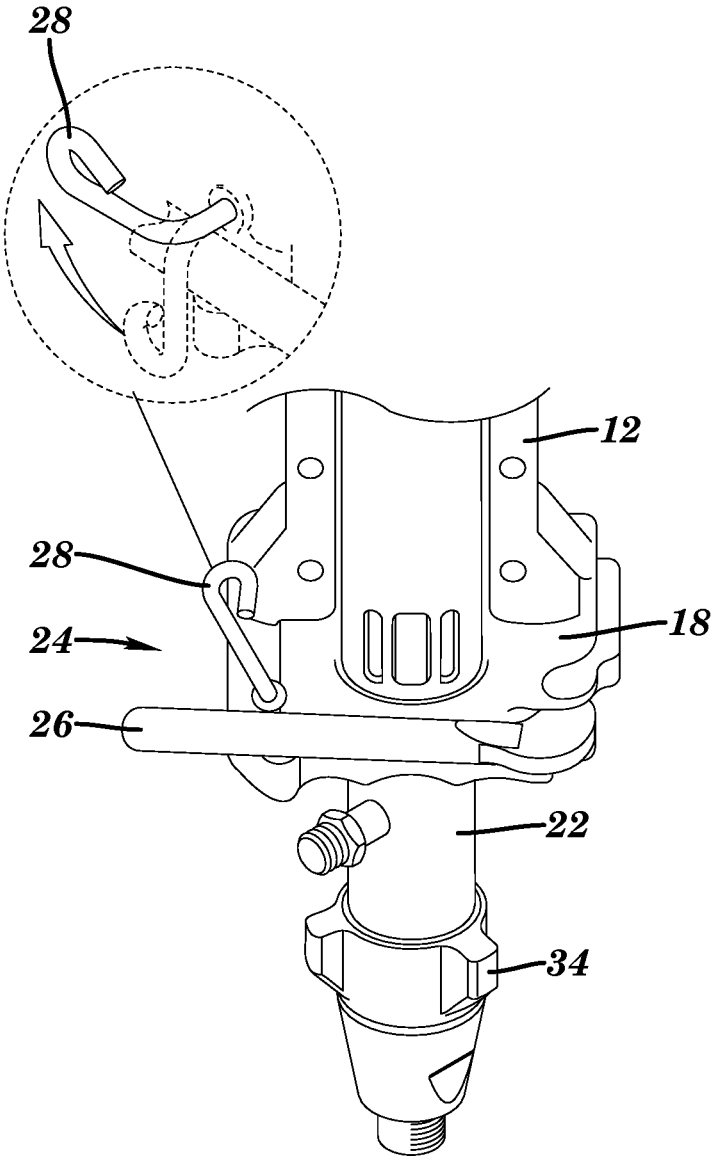
FIG. 2 is a perspective showing the instant invention with the safety latch swung opened.
Figure 3:
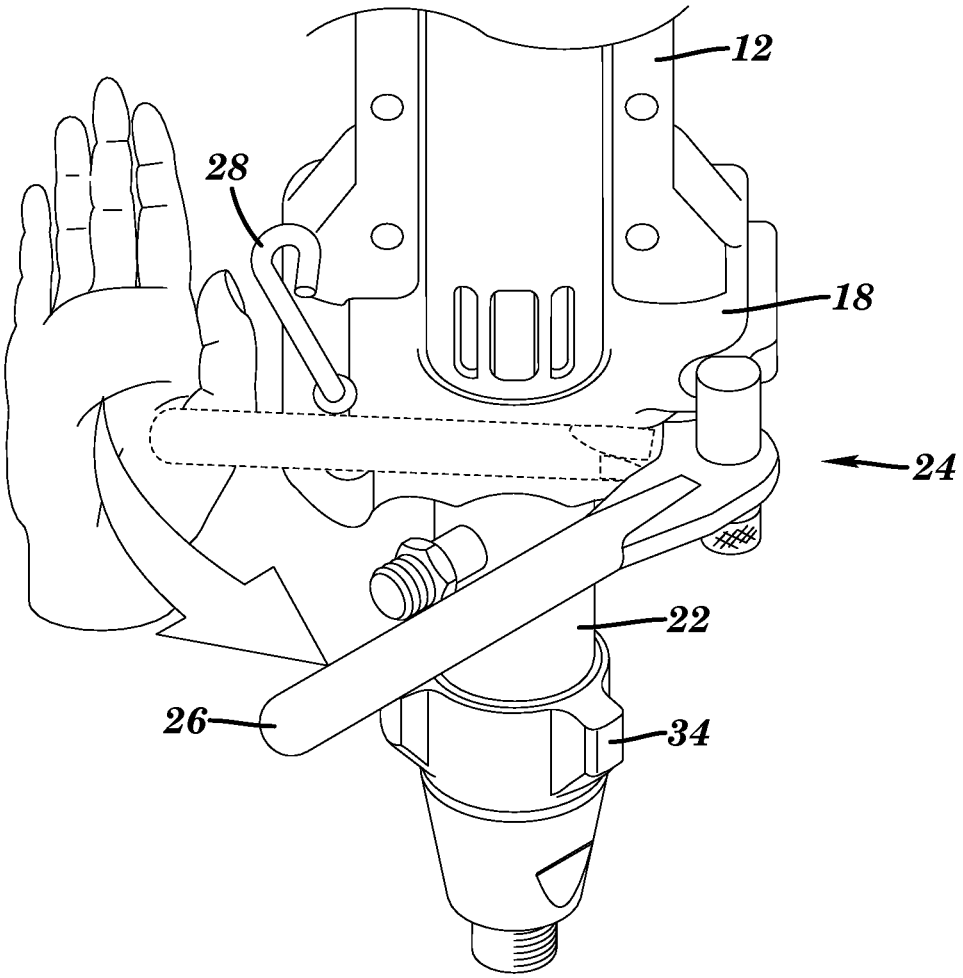
FIG. 3 is a perspective showing the instant invention with the handle being swung open.
Figure 4:
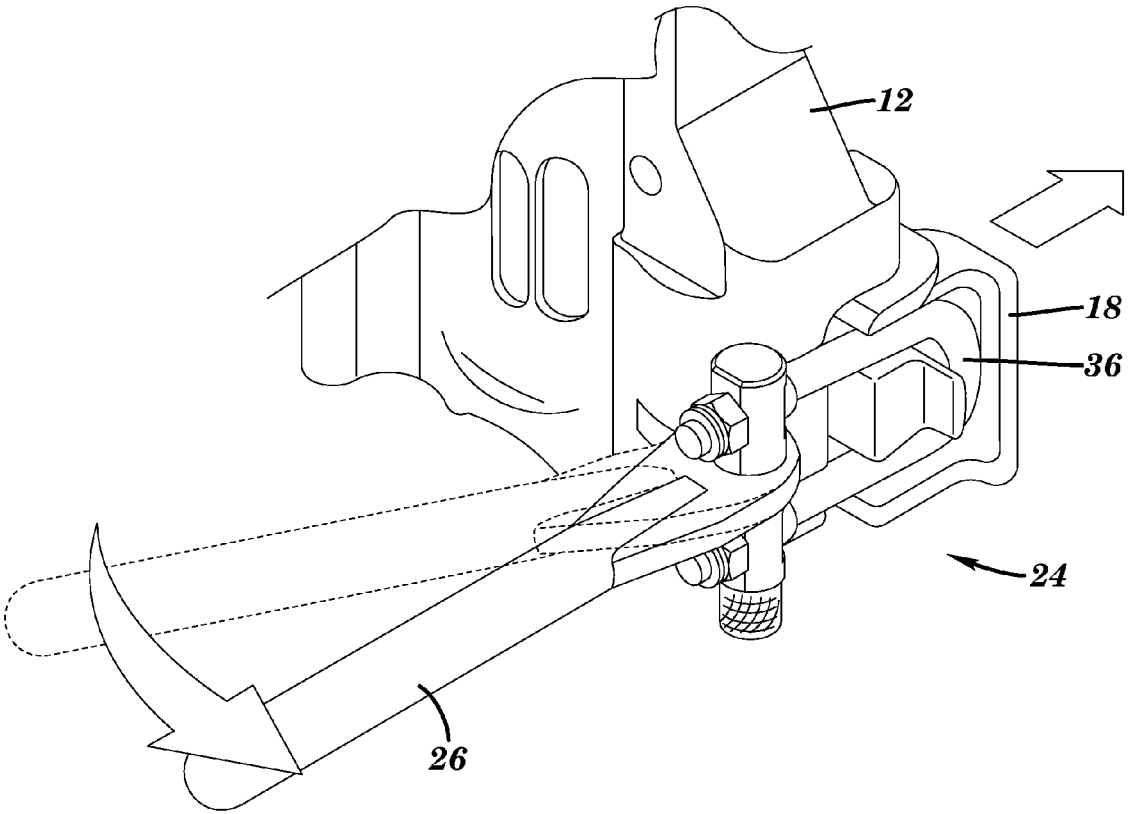
FIG. 4 is a perspective showing the instant invention showing the door being ratcheted open.
Figure 5:
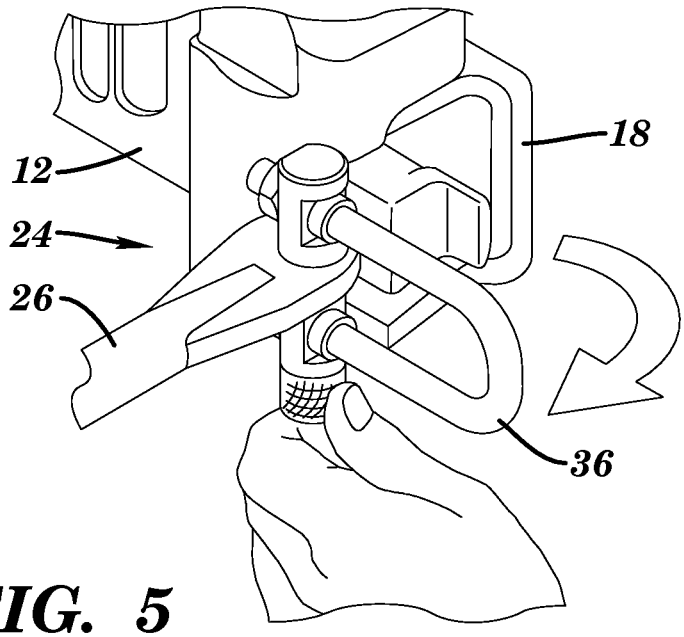
FIG. 5 is a perspective showing the instant invention with the u-bolt being repositioned.

In the instant invention, the "no tools" pump removal system comprises a bearing housing 12 attached to the drive housing 14 of an airless sprayer 10 which also has a power source 16. The bearing housing 12 has a hinged door 18 that when opened allows removal of the pump pin 20 and thence the pump 22. The bearing housing 12 is provided with a latch assembly 24 and a handle 26. A safety latch 28 pivots and releasably retains the handle 26 in place during operation and until it is desired to remove the pump 22.

Figure 6:
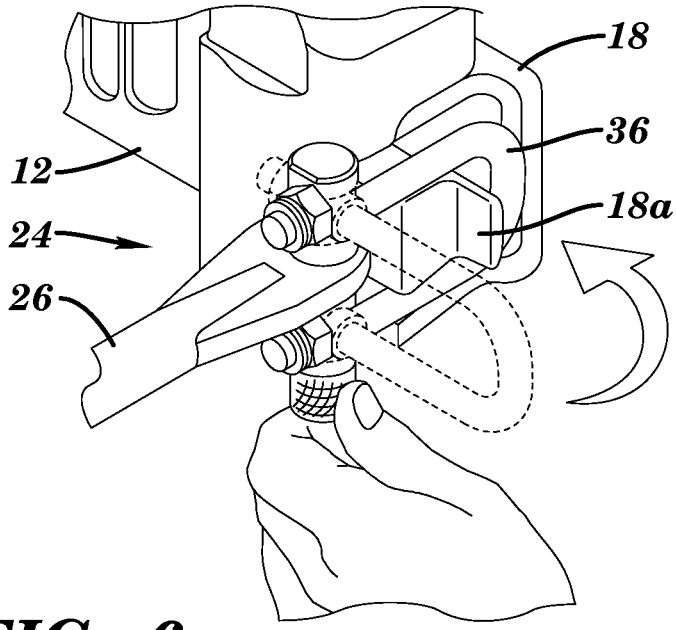
FIGS. 6 and 7 are perspectives showing the instant invention with the u-bolt being, used to unstuck a stuck door.
Figure 7:
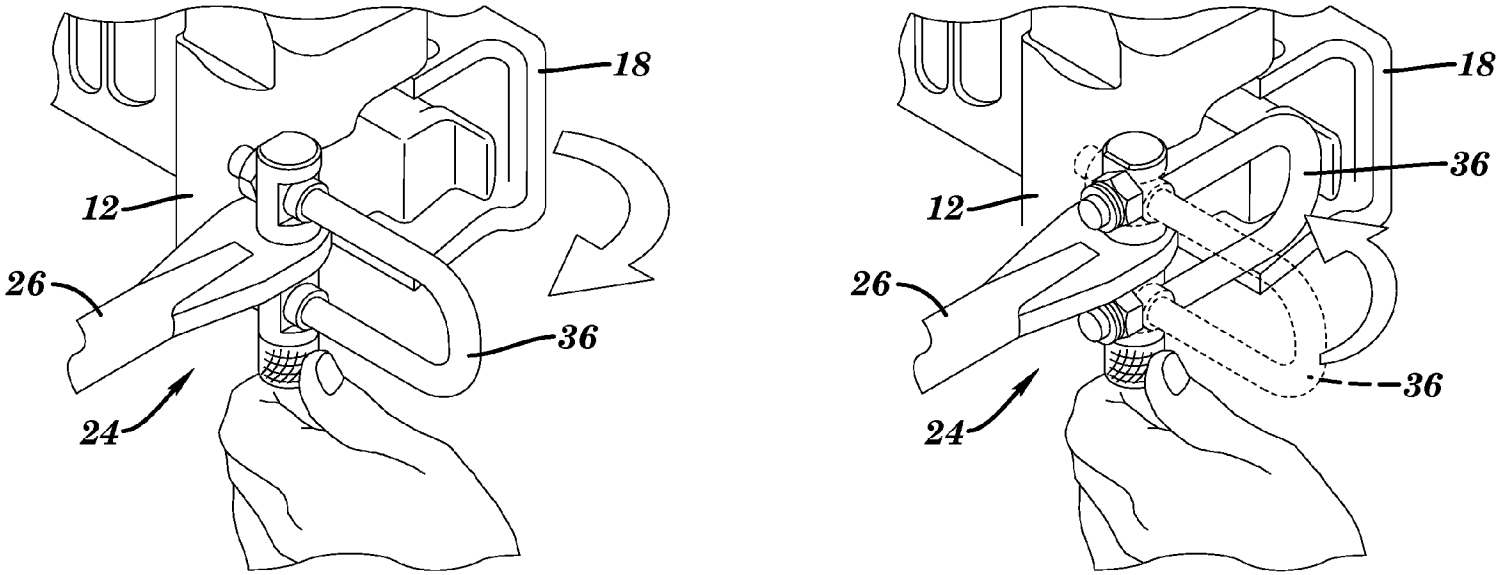
Figure 8:
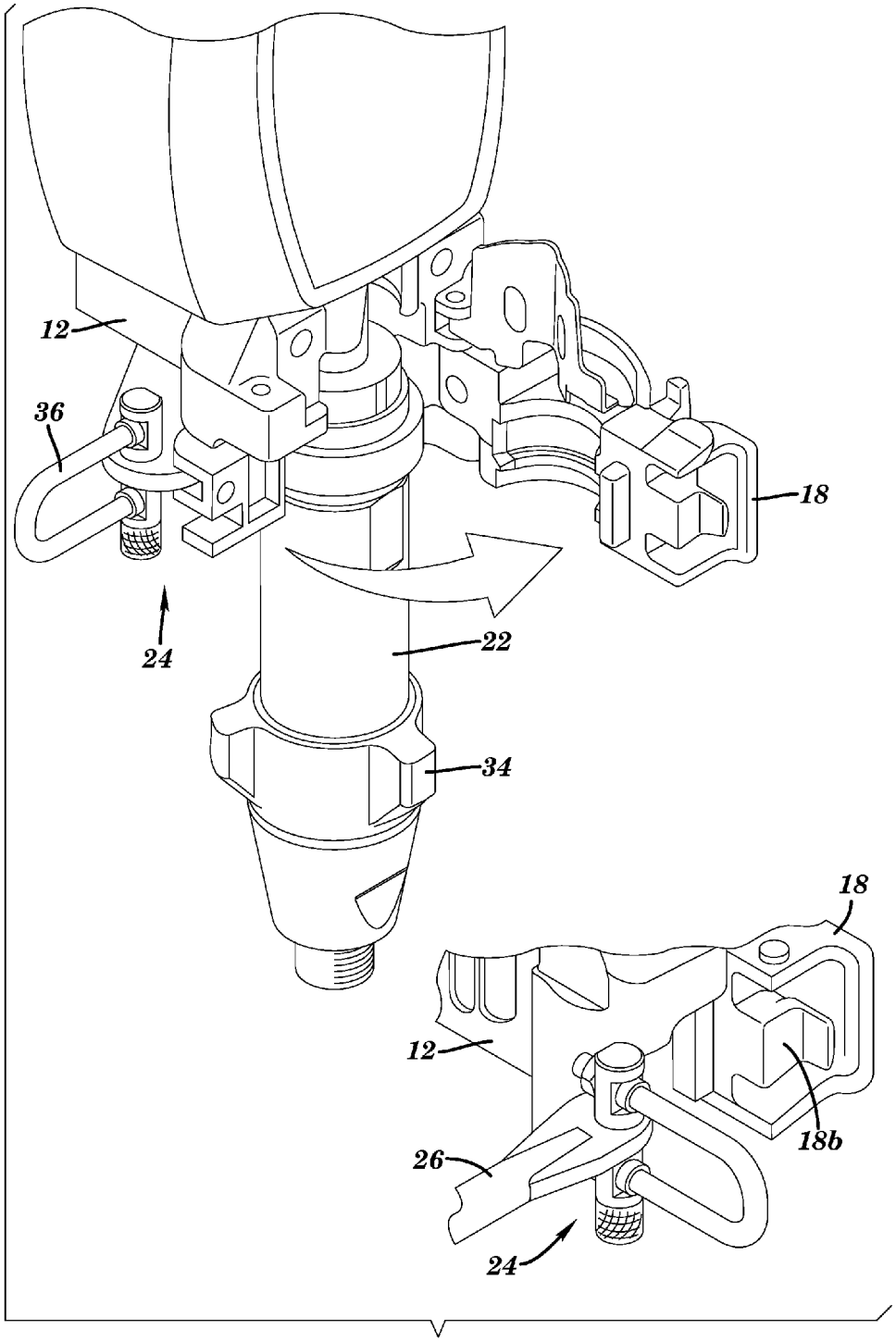
FIG. 8 is a perspective showing the instant invention with the door being opened.
Figure 9:
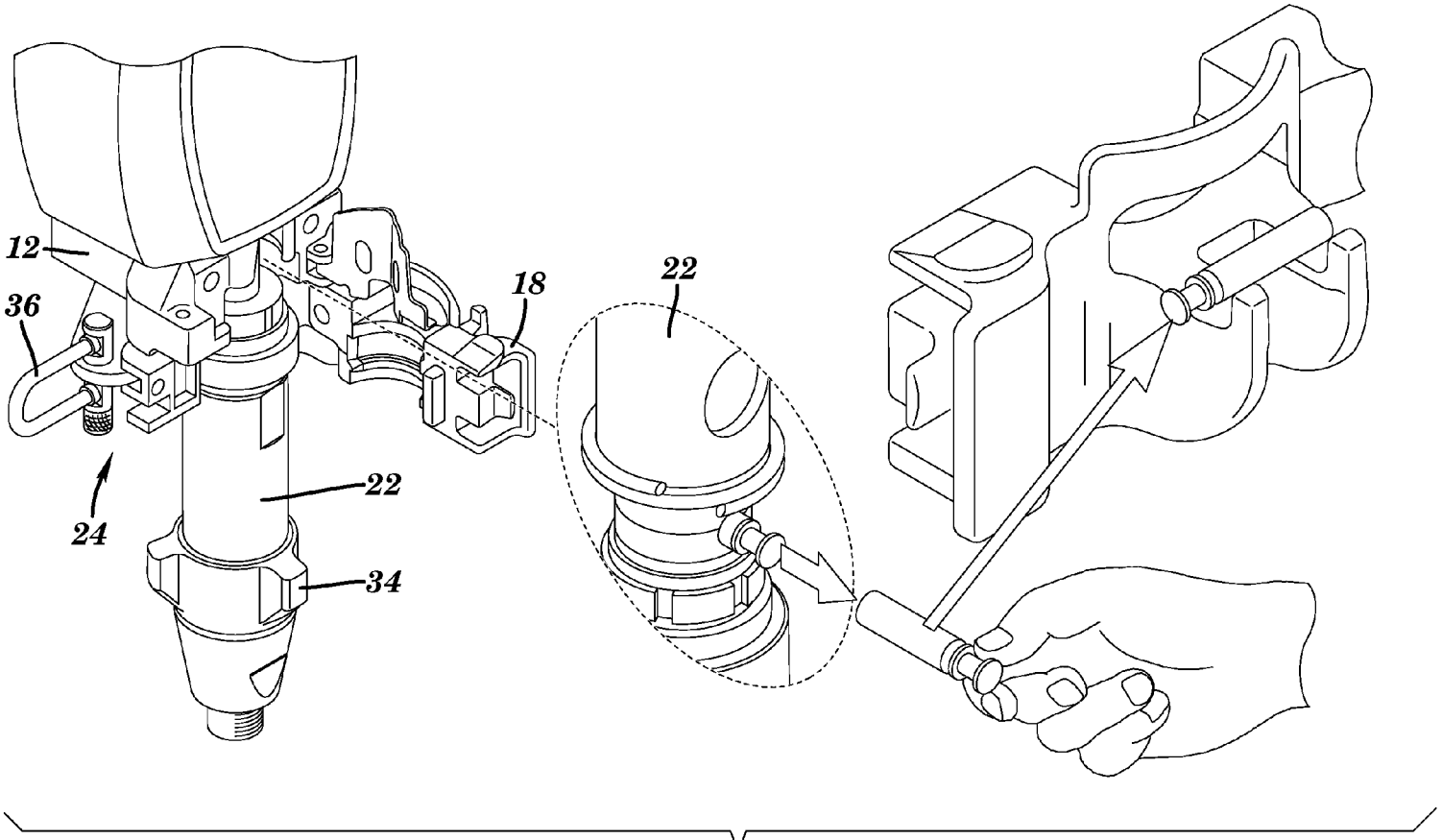
FIG. 9 is a perspective showing the instant invention with the pump pin being pulled.
Figure 10:
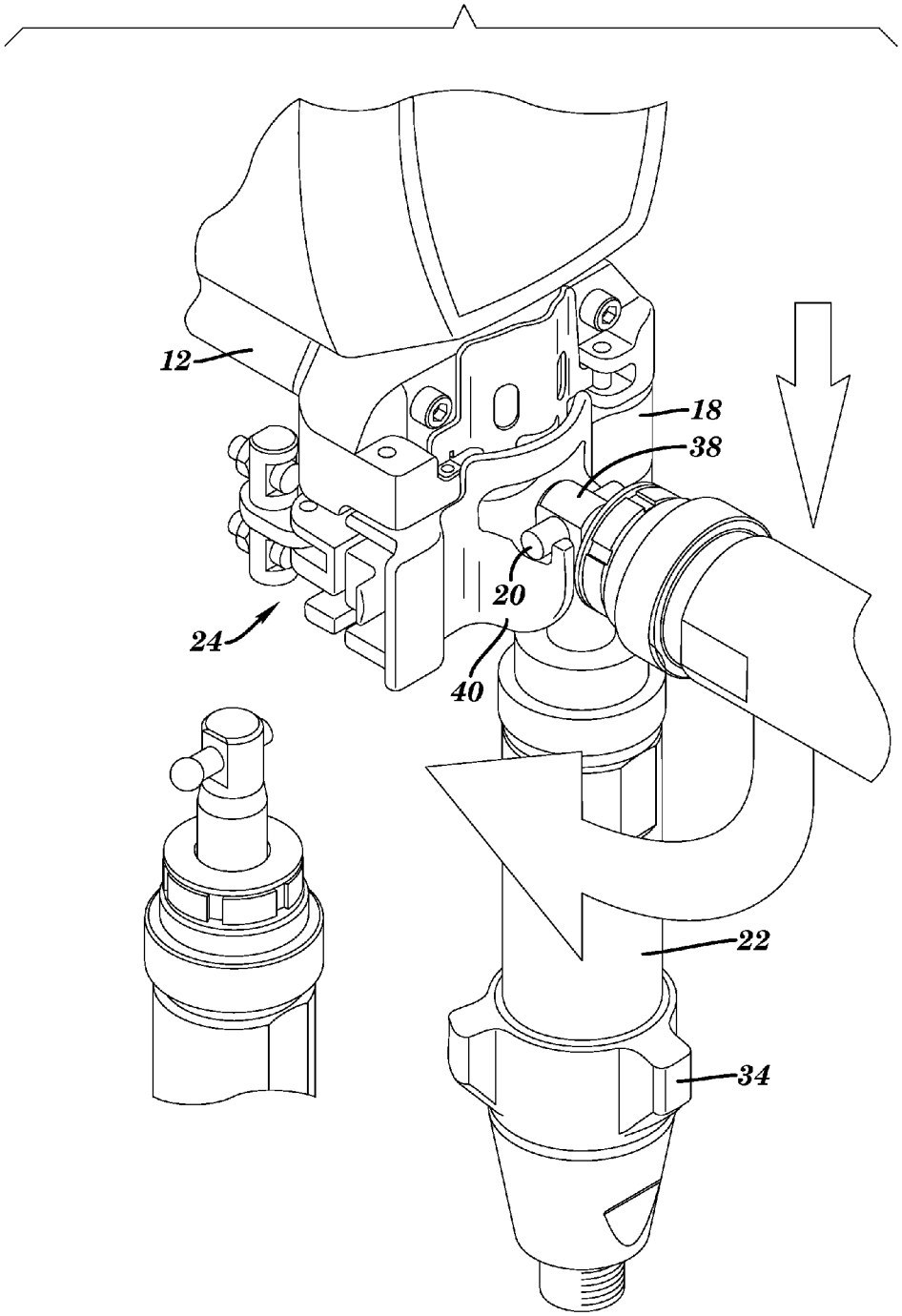
FIG. 10 is a perspective showing the instant invention showing the pump being installed.
Figure 11B:
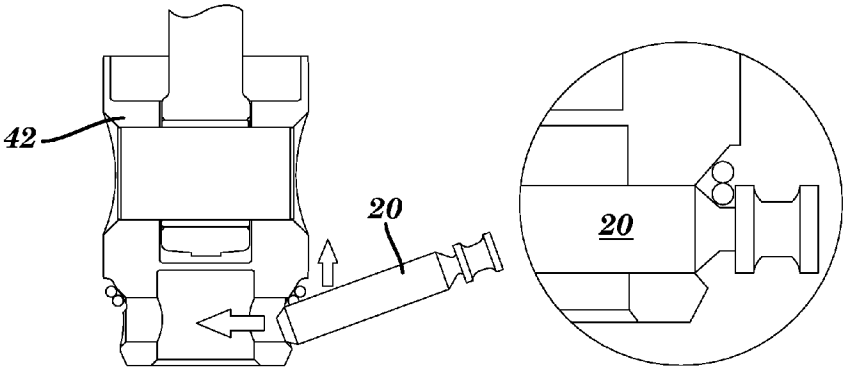
FIG. 11 is a perspective showing the instant invention with the pump pin being installed.
Figure 11:
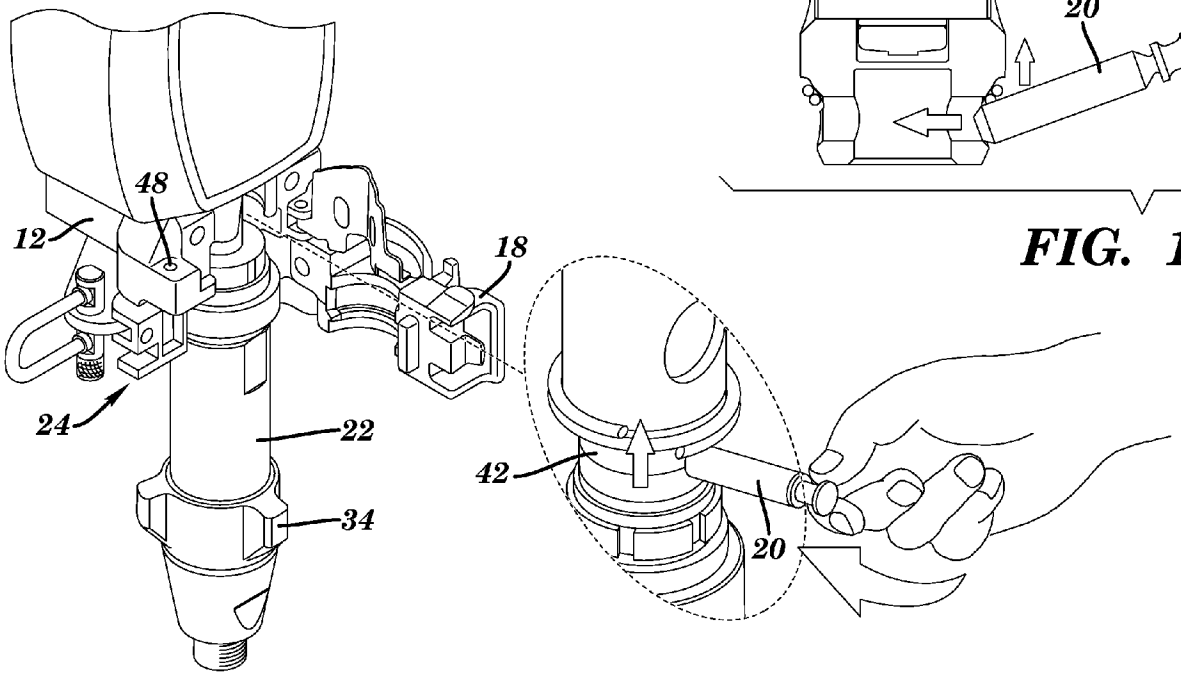
Figure 12:
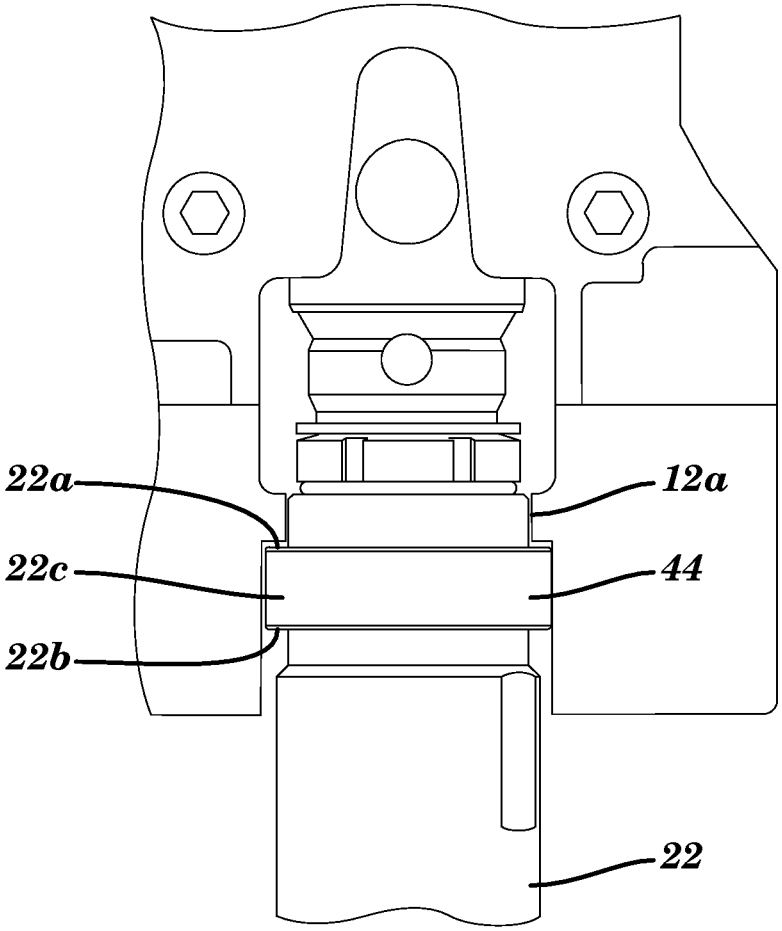
FIG. 12 is a cross-section showing the pump of the instant invention installed in the bearing housing.

To remove, first the pressure in the pump 22 is relieved (using the mechanism present in all airless pumps) and then the paint hose 30 is removed by unscrewing the ribbed fitting 32 and fine thread 34 by hand. At that point, the safety latch 28 is lifted and the handle 26 swung outwardly releasing the u-bolt latch 36 from the door 18. If the door 18 will not swing freely outwardly (because of accumulated dried paint), the u-bolt may be positioned on the near side 18*a* of the door 18 as shown in FIG. 6 and used to lever it outwardly to unstick the door 18. At this point, the pump pin 20 can be grasped and removed which allows the pump 22 to drop straight down for replacement or repacking.

To install the pump 22, the pump pin 20 can be placed in the rod 38 of pump 22 and then placed in the pin holder 40 on the door 18 to pull rod 38 out to the proper position such that the top of the collar 46 on the pump cylinder 44 is nearly against the mating shoulder 12*a* in the bearing housing 12. The pump can then be positioned on the connecting rod 42 and the pin 20 slid into place. The door 18 is then swung shut and the latch u-bolt 36 placed over the door latch protrusion 18*b* and the handle 26 swung shut. The safety latch 28 may then be operated.

It should be noted that the pump cylinder 44 is supported only on top in the bearing housing cavity at shoulder 12*a* which allows the pump 22 to drop during removal. The door 18 supports the top 22*a* and bottom 22*b* of the pump cylinder 22 taking up all of the downward force. The pump cylinder has a collar 22*c* that slides into the bearing housing and has flat (not tapered) surfaces on top 22*a* and bottom 22*b* to prevent the collar 22*c* from wedging into the bearing housing 12. A adjustment screw 48 is provided where the door 18 latches into the bearing housing 12 to reduce unwanted movement.

It is contemplated that various changes and modifications may be made to the pump without departing from the spirit and scope of the invention as defined by the following claims.

What is claimed is:

1. A reciprocating piston pump for attachment to a reciprocating drive and having a reciprocating rod, a cylinder and a bearing housing, the improvement comprising a door attached to said bearing housing so as to releasably sandwich said cylinder between said bearing housing and said door and a latch mechanism configured to secure said door to said bearing housing, said cylinder comprising a cylindrical shoulder configured to mate with said bearing housing and said shoulder comprising upper and lower ends and said bearing housing comprises a shoulder that bears against said cylinder upper shoulder end, said door comprising an annular groove configured to mate with and retain said cylinder upper and lower shoulder ends.

2. The reciprocating piston pump of claim 1 wherein said latch mechanism comprises a latch member and is operable between a first position securing said door to said bearing housing and a second position where said door may be swung open from said bearing housing.

3. The reciprocating piston pump of claim 2 wherein said latch mechanism comprises a protrusion on said door having first and second sides, said latch member cooperating with said protrusion first side to secure said door to said bearing housing and said latch member cooperating with said protrusion second side to force said door to swing open from said bearing housing.

4. The reciprocating piston pump of claim 1 wherein said door comprises a distal end remote from said attachment, said bearing housing comprising a screw configured to adjust friction engagement tension between said distal end and said bearing housing.

5. The reciprocating piston pump of claim 1 wherein said drive mechanism comprises a connecting rod and said pump further comprising a pump pin manually releasably connecting said reciprocating rod and said connecting rod.

6. A reciprocating piston pump assembly comprising:

a pump including:

a pump cylinder having a collar extending radially outward, wherein the collar includes a collar top and a collar bottom positioned opposite the collar top; and a reciprocating rod extending at least partially into the pump cylinder;

a bearing housing defining a cavity with a bearing housing shoulder extending into the cavity, wherein the pump cylinder is positioned at least partially in the bearing housing cavity with the collar top positioned adjacent a bottom of the bearing housing shoulder, and wherein the bearing housing cavity is substantially open below the bearing housing shoulder so as to allow the pump cylinder to drop away from the bearing housing shoulder in a direction that is initially entirely axial when being released from the bearing housing; and a bearing housing door attached to the bearing housing and having a groove configured to receive the collar and support the collar at the collar top and at the collar bottom.

7. The reciprocating piston pump assembly of claim 6, wherein the bearing housing door is hingedly attached to the bearing housing, and the groove is in a substantially circumferential direction.

8. The reciprocating piston pump assembly of claim 6, and further comprising:

a latch assembly comprising:

a handle pivotably connected to the bearing housing;

a latch connected to the handle and extending toward the bearing housing door and configured to attach to a protrusion hook of the bearing housing door when the bearing housing door is closed adjacent the bearing housing.

9. The reciprocating piston pump assembly of claim 6, and further comprising:

a latch pivotably connected to the bearing housing at a position proximate a handle and configured to retain the handle when the latch is in a first position and to release the handle when the latch is pivoted to a second position.

10. The reciprocating piston pump assembly of claim 8, wherein the latch comprises a u-bolt latch.

11. The reciprocating piston pump assembly of claim 6, wherein the collar top is substantially flat and extending substantially radially outward from the pump cylinder in a direction substantially normal to an axis of the pump cylinder.

12. The reciprocating piston pump assembly of claim 11, wherein the collar bottom is substantially flat, extending substantially radially outward from the pump cylinder in the direction normal to the axis of the pump cylinder.

13. The reciprocating piston pump assembly of claim 6, wherein the collar bottom is substantially parallel to the collar top.

14. The reciprocating piston pump assembly of claim 6, wherein the reciprocating rod extends from a position below the bearing housing shoulder to a position above the bearing housing shoulder.

15. The reciprocating piston pump assembly of claim 14, wherein the reciprocating rod defines a hole through which a pump pin extends to connect the reciprocating rod to a connecting rod.

16. The reciprocating piston pump assembly of claim 15, wherein the bearing housing door comprises a pin holder configured to engage with the pump pin to pull the reciprocating rod at least partially out of the pump cylinder.

17. The reciprocating piston pump assembly of claim 6, and further comprising:

a drive housing of an airless sprayer connected to the bearing housing at a side of the bearing housing opposite of the pump.

18. The reciprocating piston pump assembly of claim 17, wherein the reciprocating rod defines a hole through which a pump pin extends to connect the reciprocating rod to a connecting rod to connect the reciprocating rod to the drive housing.

19. A reciprocating piston pump assembly comprising:

a pump including:

a pump cylinder having a collar extending radially outward, wherein the collar includes a collar top and a collar bottom positioned opposite the collar top; and a reciprocating rod extending at least partially into the pump cylinder;

a bearing housing defining a cavity with a bearing housing shoulder extending into the cavity, wherein the pump cylinder is positioned at least partially in the bearing housing cavity with the collar top positioned adjacent a bottom of the bearing housing shoulder, and wherein the bearing housing cavity is substantially open below the bearing housing shoulder so as to allow the pump cylinder to drop away from the bearing housing shoulder when being released from the bearing housing;

a bearing housing door attached to the bearing housing and having a groove configured to receive the collar and support the collar at the collar top and at the collar bottom; and a latch assembly comprising:

a handle pivotably connected to the bearing housing;

a latch connected to the handle and extending toward the bearing housing door and configured to attach to a protrusion hook of the bearing housing door when the bearing housing door is closed adjacent the bearing housing, wherein the latch comprises a u-bolt latch.

* * * * *